US009205434B2

(12) United States Patent
Soltvedt et al.

(10) Patent No.: US 9,205,434 B2
(45) Date of Patent: Dec. 8, 2015

(54) NOZZLE FOR CREATING A WATER HEAT SHIELD WHEN FLARING WASTE GASES

(75) Inventors: Terje Morten Soltvedt, Sandnes (NO); Daniel Soltvedt, Sandnes (NO); Sven Egil Tjørholm, Sandnes (NO)

(73) Assignee: SWT AS, Sola (NO)

( * ) Notice: Subject to any disclaimer, the term of this patent is extended or adjusted under 35 U.S.C. 154(b) by 0 days.

(21) Appl. No.: 14/001,417

(22) PCT Filed: Feb. 23, 2012

(86) PCT No.: PCT/NO2012/050028

§ 371 (c)(1),
(2), (4) Date: Aug. 23, 2013

(87) PCT Pub. No.: WO2012/115524

PCT Pub. Date: Aug. 30, 2012

(65) Prior Publication Data

US 2013/0327844 A1 Dec. 12, 2013

(30) Foreign Application Priority Data

Feb. 24, 2011 (NO) ..... 20110306

(51) Int. Cl.
*B05B 1/14* (2006.01)
*B05B 1/20* (2006.01)
(Continued)

(52) U.S. Cl.
CPC ... *B05B 1/20* (2013.01); *B05B 1/02* (2013.01); *B05B 1/06* (2013.01); *B05B 1/14* (2013.01); *A62C 2/08* (2013.01)

(58) Field of Classification Search
CPC ..... B05B 1/20; B05B 1/02; B05B 1/04; B05B 1/044; B05B 1/046; B05B 1/06
USPC ..... 239/589, 590–950.5, 601, 566, 550, 239/558, 568, 556, 557, 592–595
See application file for complete search history.

(56) References Cited

U.S. PATENT DOCUMENTS 1,599,592 A * 9/1926 Sladden ..... 239/444
1,605,622 A 11/1926 Sladden
(Continued)

FOREIGN PATENT DOCUMENTS

| | | |
|---|---|---|
| DE | 20318317 | 3/2005 |
| GB | 1521307 | 8/1978 |
| WO | 2009/132867 | 11/2009 |

OTHER PUBLICATIONS

International Search Report mailed Jul. 3, 2012 which issued in corresponding International Patent Application No. PCT/NO2012/050028 (3 pages).
(Continued)

*Primary Examiner* — Jason Boeckmann
(74) *Attorney, Agent, or Firm* — Nixon Peabody LLP

(57) ABSTRACT

The present invention provides a nozzle 1 for generating a water shield, the nozzle comprises a nozzle body 2 being hollow and having a substantially circular circumference, said nozzle body comprises a first and second end 3,4 and an inner 7 and an outer 6 surface, the first end 3 is open and has a construction suited for coupling to a source of pressurized water, and the second end 4 is closed, the nozzle body further comprises multiple holes 5 extending from the inner to the outer surface, the holes arranged in at least one row extending around at least parts of the substantially circular circumference, the holes having a cross-section at the inner and outer surface of the nozzle body, wherein the cross-section of the holes 5 has a larger area at the inner surface 7 of the nozzle body than at the outer surface 6.

13 Claims, 6 Drawing Sheets

(51) Int. Cl.

| | |
|---|---|
| ***B05B 1/02*** | (2006.01) |
| ***B05B 1/06*** | (2006.01) |
| *A62C 2/08* | (2006.01) |

(56) References Cited

U.S. PATENT DOCUMENTS

| | | | | | |
|---|---|---|---|---|---|
| 2,993,650 | A | * | 7/1961 | Badberg | 239/271 |
| 3,212,719 | A | * | 10/1965 | Di Corpo | 239/541 |
| 3,544,370 | A | * | 12/1970 | Wrede | 134/37 |
| 3,807,932 | A | | 4/1974 | Dewald | |
| 4,349,073 | A | * | 9/1982 | Zublin | 166/312 |
| 4,841,999 | A | * | 6/1989 | Danko | 134/22.1 |
| 5,964,419 | A | * | 10/1999 | Lovett | 239/532 |
| 6,622,947 | B1 | * | 9/2003 | Rivera | 239/566 |
| 8,066,201 | B2 | * | 11/2011 | So | 239/1 |

OTHER PUBLICATIONS

International Preliminary Report on Patentability mailed May 13, 2013 which issued in corresponding International Patent Application No. PCT/NO2012/050028 (4 pages).

* cited by examiner

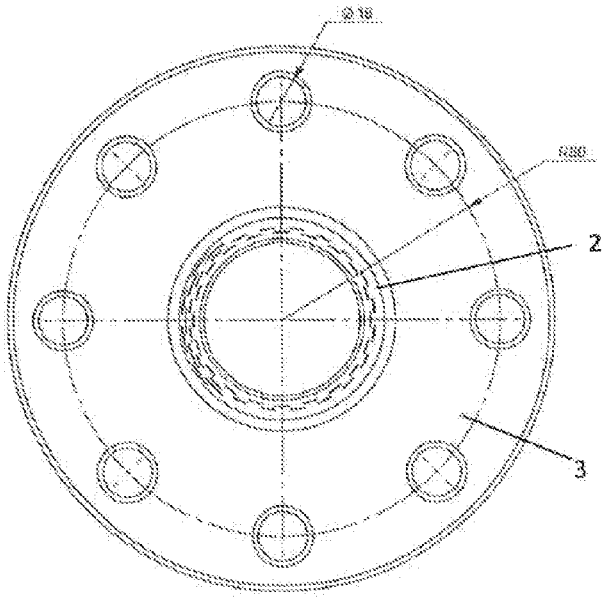
Fig. 3 cross-section A-A
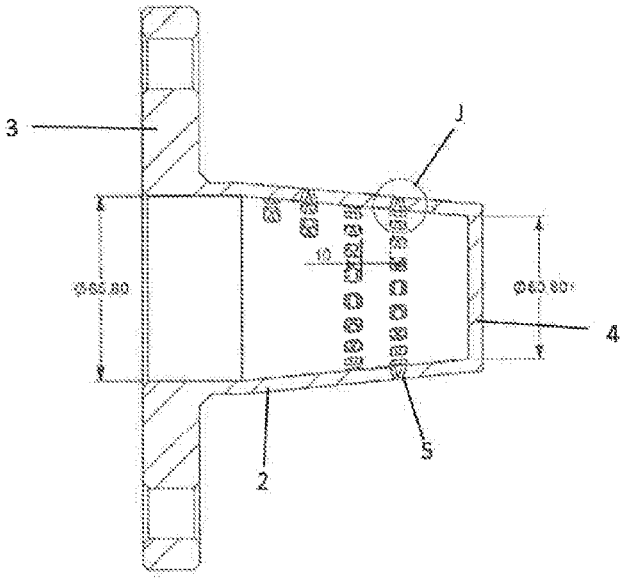
Fig. 4 cross-section B-B

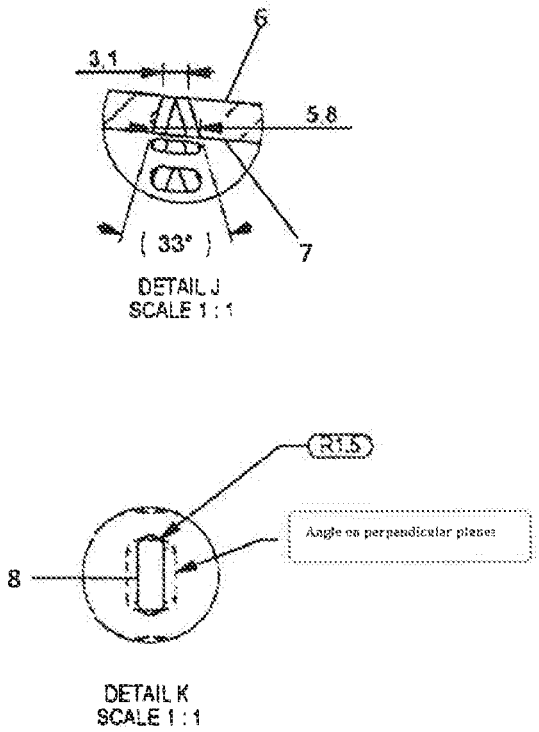
Fig. 5 Details J and K

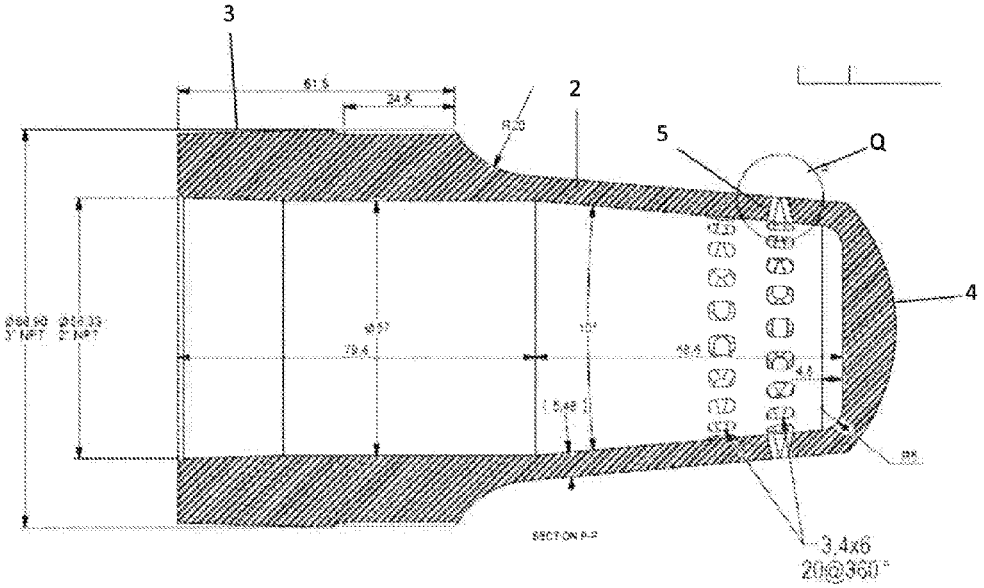
Fig. 7 cross-section P-P
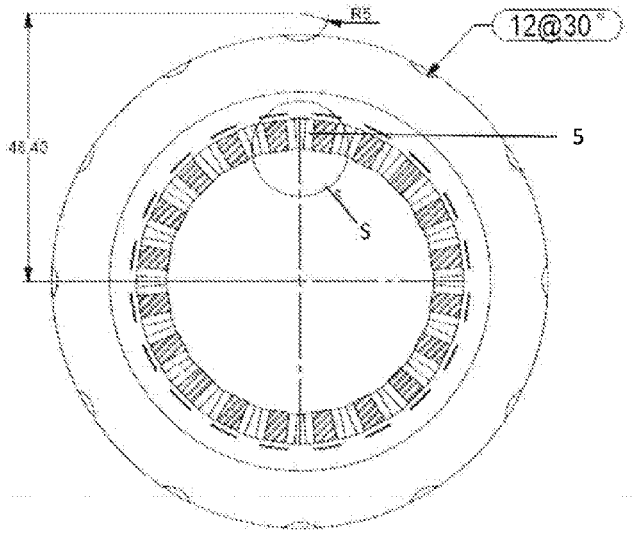
Fig. 8 cross-section R-R

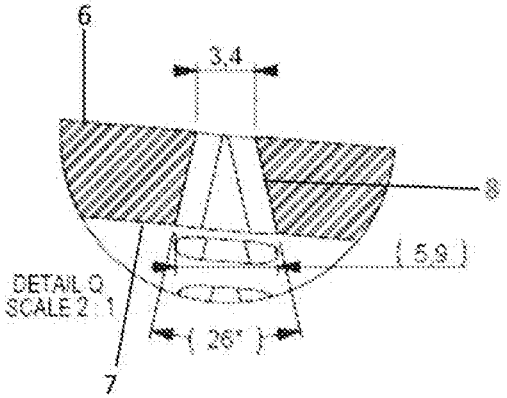
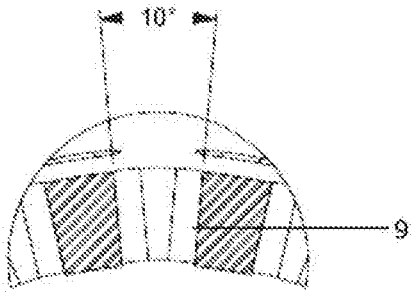
Fig. 9 Details Q and S

NOZZLE FOR CREATING A WATER HEAT SHIELD WHEN FLARING WASTE GASES

CROSS-REFERENCE TO RELATED APPLICATIONS

This application is a U.S. national stage of International Patent Application No. PCT/NO2012/050028 filed Feb. 23, 2012 which claims priority to Norwegian Patent Application No. 20110306, filed Feb. 24, 2011, the contents of which are incorporated herein by reference in its entirety.

TECHNICAL FIELD OF INVENTION

The present invention concerns a nozzle. The nozzle is particularly suited for generating a water shield, and consequently for use in protecting against heat generated during the flaring of gas in oil/gas production.

BACKGROUND OF THE INVENTION

In oil/gas production it is necessary to get rid of hydrocarbons during the testing/test-production of wells.

Several nozzles of various designs are known for use with the aim of creating a water shield which protects the platform, equipment and people from the intense heat which arises when excess of hydrocarbons, oil or gas, is burnt by using so called flaring, i.e. the burning of said hydrocarbons from a flaring boom.

Both patent application GB 2433710 A and GB 2465427 A shows nozzles for the generation of a water shield for heat protection during flaring. The nozzles are closely related and use a deflector plate at the end of the nozzle in order to achieve the desired water shield.

The nozzles presently in use consist of a number of moveable parts which requires a high level of maintenance. Further, said nozzles do not have the possibility for an asymmetric design of the water shield or several water shields at the same time, they are not suited for highly pressurized water (only max 20 bar), and may easily be clogged.

The aim of the present invention is to provide a nozzle for generating a water shield, while at the same time avoiding or alleviating at least one, preferably several, of the disadvantages of the presently used nozzles.

ABSTRACT OF THE INVENTION

The present invention provides a nozzle for generating a water shield.

Accordingly, the invention is further defined by:

A nozzle for generating a water shield, comprising a substantially circular and hollow nozzle body with a first and second end and an inner and an outer surface, the first end of the nozzle body is open and has a construction suited for coupling to a source of pressurized water, the second end is closed, the nozzle body comprises multiple holes extending from the inner surface to the outer surface, the holes arranged in at least one row extending around at least parts of the substantially circular circumference of the nozzle body, the holes having across-section at the inner and outer surface of the nozzle body, said cross-section having a larger area at the inner surface than at the outer surface.

In one embodiment of the nozzle, the cross-section of the holes, at the inner and outer surface of the nozzle body, comprises two first sides, the first sides being parallel to each other and perpendicular to a centerline of the nozzle body, and two second sides.

In one embodiment of the nozzle, the spacing between the first sides is less at the outer surface of the nozzle body than at the inner surface.

In one embodiment of the nozzle, the cross-section of the holes at the outer and inner surface, comprises two first sides, the first sides being parallel to each other and perpendicular to a centerline of the nozzle body, and two second sides, at least some of the holes comprises two planes extending from the outer to the inner surface of the nozzle body, each plane limited by one of the first sides at the outer and inner surface, and the two planes are inclined with respect to each other at an angle of about 20° to 45°, preferably 25° to 40°.

In one embodiment of the nozzle, the spacing between the second sides is the same at the outer surface and the inner surface.

In one embodiment of the nozzle, the spacing between the second sides is larger at the outer surface than at the inner surface.

In one embodiment of the nozzle it comprises two rows of holes around the whole circumference of the nozzle body. The nozzle may further comprise a row of holes along about one fourth of the circumference of the nozzle body, and a row of holes along about one fifth of the circumference of the nozzle body.

In one embodiment of the nozzle, the circumference of the nozzle body is larger at the first end than at the second.

In one embodiment, the nozzle comprises a flange or another suitable pipe coupling, such as 2" or 3" NPT, at the first end. Any suitable method/design for coupling the first end of the nozzle body to a high pressure water source may be used.

In one embodiment of the nozzle, the holes of the same row have an equal spacing to one end of the nozzle body.

The invention also comprises the use of a nozzle, as defined over, for the protection of equipment and personnel from heat sources.

The nozzle according to the present invention has a number of advantageous properties, including the fact that no moveable parts are necessary, it can be designed to provide water shields of several different shapes, and/or several layers of water shields at the same time, it can sustain very high water pressure (above 100 bar if desirable), the whole nozzle is preferably manufactured in stainless steel (provides a low weight and reduces the risk of clogging of the nozzle due to salt).

By customizing the holes according to the need, the nozzle can be adapted for harder working conditions. Such as for instance a harder and stronger water shield that may be optimal in strong winds, wherein the water shield must keep the height as long as possible before being broken up by the wind.

The nozzle provides a water shield having a much larger diameter than the presently used nozzles. This means that the number of nozzles which needs to be installed on the rig is significantly less.

The nozzle can use the high pressure system of the rig for the provision of cooling water. This entails a reduced need for equipment which must be adapted for using the nozzle. Presently used nozzles are not suited or designed for use of the rig's own high pressure system, and the need for third party equipment delivery is significantly larger.

SHORT DESCRIPTION OF THE DRAWINGS

FIG. 3 shows a top view of the nozzle in FIG. 2.

FIG. 4 shows a cross-section of the nozzle in FIG. 2.

FIG. 5 shows enlarged details J and K from FIGS. 4 and 2, respectively.

FIG. 7 shows a cross-section of the nozzle in FIG. 6.

FIG. 8 shows a cross-section of the nozzle in FIG. 6.

FIG. 9 shows details of nozzle holes for the nozzle in FIG. 6.

DETAILED DESCRIPTION OF THE INVENTION

An embodiment of the nozzle according to the present invention is shown in the FIGS. 1-5.

Figure 1:
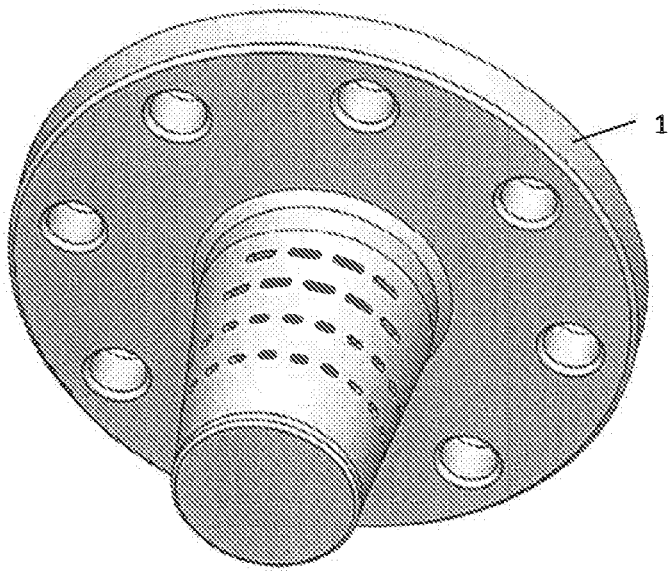
FIG. 1 shows a nozzle according to the invention.
Figure 2:
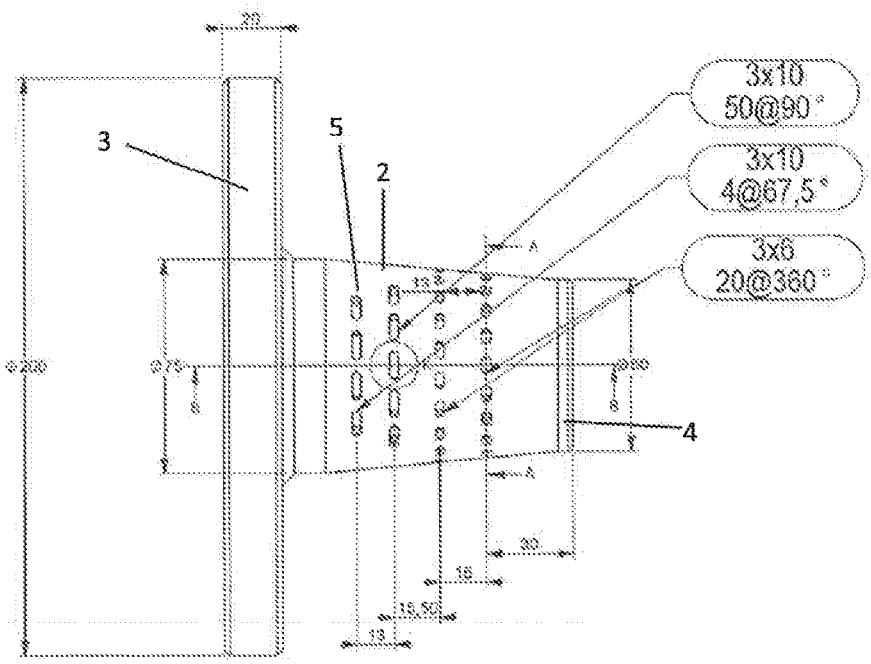
FIG. 2 shows a side view of the nozzle in FIG. 1.
Figure 6:
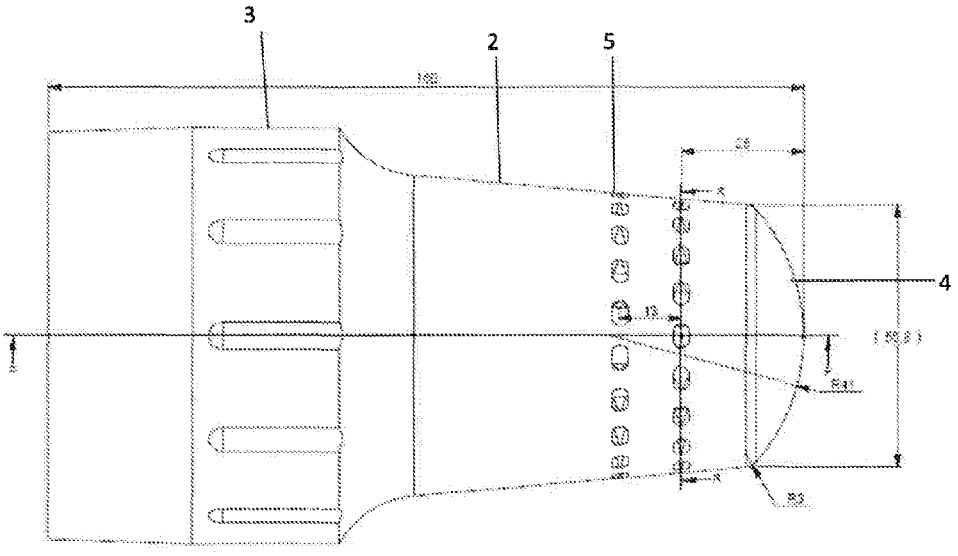
FIG. 6 shows a side view of an alternative embodiment of a nozzle according to the invention.

The nozzle 1, see FIG. 1, is mounted via the end 3 to a corresponding coupling on a pipe for the supply of water under high pressure, see FIGS. 2 and 4. In this embodiment, the end 3 of the nozzle comprises a flange. A gasket is mounted in between the bearing surfaces.

Supplied water will enter the nozzle body 2 and pushed out via the holes 5. Due to the design of the holes 5, see FIG. 5 detail K and J, the water will pass through the holes 5 from the inner surface 7 of the nozzle body to the outer surface 6 and leave the nozzle body 2 having a very high velocity. The water leaves the nozzle body 2 with a direction which makes the water keep together in a straight beam before it loses its kinetic energy and falls down. This effect is achieved by, among other things, inclining two of the opposing planes of the holes (the holes can be either substantially oval or rectangular), the planes that are perpendicular with regards to the direction of the supplied water (or the longitudinal direction of the nozzle body), in towards each other in the direction out of the nozzle. The inclination angle between the planes is preferably about 25-40°. The two other opposing planes of the hole, the planes which are not perpendicular with regards to the direction of the supplied water, are either parallel to each other or inclined away from each other in the direction out of the nozzle. In this specific connection it shall be noted that the holes may have a cross-section which is substantially oval or rectangular, and that the terms perpendicular and parallel is to be broadly interpreted in that they also include the case that the opposing planes of the holes are more or less bow shaped.

The water which is pushed through the two rows of holes 5, which are closest to the first end 3, wherein highly pressurized water is supplied, will leave the nozzle body 2 in a larger amount, and with correspondingly increased energy, to achieve a higher vertical beam than what is achieved for the two rows of holes 5 furthest from said first end. This beam will preferably have its area of effect in a direction between 10:00 and 14:00 hours. The water which leaves the nozzle body 2 through the row of holes closest to the first end 3, the end comprising a flange, will prevent heat radiation towards the rig during an operation performed when wind is non-existent or weak.

In other embodiments of the nozzle, the first end 3, which is coupled to the high-pressure water supply, is designed such that it may be coupled by using other coupling means than a flange. These techniques include various types of threads, such as 2" and 3" NPT (National Pipe Thread Taper), and other suitable coupling means known to the skilled person. One such alternative embodiment is shown in FIGS. 6-9, wherein the first end which is coupled to the water supply is intended for a coupling according to 2" or 3" NPT.

The number, positioning and design of the holes, and the rows formed by these, may be varied according to the desired dimension and direction of the water shield(s). In this regard, the nozzle shown in the FIGS. 6-9 has only to rows of holes for generating a symmetrical water shield.

The invention claimed is:

1. A nozzle for generating a water shield suitable for protecting against heat generated during flaring of hydrocarbons in oil or gas production, the nozzle comprising a one-piece nozzle body being hollow and having a substantially circular circumference, said nozzle body comprising a first and second end and an inner and an outer surface, the first end being open and having a flange suited for coupling to a source of pressurized water, and the second end being closed, the nozzle body further comprising multiple holes extending from the inner to the outer surface, the holes being arranged in at least one row extending around at least part of the substantially circular circumference, the holes having a cross-section at the inner and outer surface of the nozzle body, wherein the holes taper from the inner to the outer surface so that the cross-section of the holes has a larger area at the inner surface of the nozzle body than at the outer surface, wherein the cross-section of each of a plurality of the multiple holes at the outer and inner surface of each such hole comprises two first opposing sides being parallel to each other and perpendicular to a centerline of the nozzle body, each such hole comprising two opposing planes extending from the outer to the inner surface of the nozzle body, each opposing plane of each such hole being limited by the first opposing sides at the outer and inner surface, and the two opposing planes of each such hole being inclined with respect to each other at an angle of 20° to 45°.

2. A nozzle according to claim 1, comprising two rows of holes around the substantially circular circumference of the nozzle body.

3. A nozzle according to claim 2, further comprising a third row of holes extending around about one fourth of the circumference of the nozzle body, and a fourth row of holes extending around about one fifth of the circumference of the nozzle body.

4. A nozzle according to claim 1, wherein the circular circumference of the nozzle body is larger at the first end than at the second end.

5. A nozzle according to claim 1, wherein the two planes are inclined with respect to each other at an angle of 25° to 40°.

6. The nozzle for generating a water shield in accord with claim 1, wherein the multiple nozzle body holes extending from the inner to the outer surface are arranged in at least one row circumscribing the substantially circular circumference.

7. A nozzle according to claim 1, wherein at least some of the multiple nozzle body holes define an opening at the outer surface of the nozzle body characterized by an elongated opening having a major dimension and a minor dimension, with the major dimension being greater than the minor dimension.

8. The nozzle according to claim 7, wherein the opening at the outer surface of the nozzle body of the at least some of the nozzle body holes are further characterized by parallel sides along the major dimension of the opening.

9. The nozzle according to claim 7, wherein at least some of the multiple nozzle body holes define an opening at the inner surface of the nozzle body characterized by an elongated opening having a major dimension and a minor dimension, with the major dimension being greater than the minor dimension.

10. The nozzle according to claim 9, wherein the opening at the inner surface of the nozzle body of the at least some of the nozzle body holes are further characterized by parallel sides along the major dimension of the opening.

11. The nozzle according to claim 10, wherein the opening at the outer surface of the nozzle body of the at least some of the nozzle body holes are further characterized by parallel sides along the major dimension of the opening.

12. A nozzle for generating a water shield suitable for protecting against heat generated during flaring of hydrocarbons in oil or gas production, the nozzle comprising:

a one-piece nozzle body being hollow and having a substantially circular circumference, said nozzle body comprising a first and second end and an inner and an outer surface, the first end being open and the second end being closed, the nozzle body further comprising multiple holes extending from the inner to the outer surface, the holes being arranged in at least one row extending around at least part of the substantially circular circumference, the holes having a cross-section at the inner and outer surface of the nozzle body, wherein the holes taper from the inner to the outer surface so that the cross-section of the holes has a larger area at the inner surface of the nozzle body than at the outer surface, wherein the cross-section of at least some of the multiple holes, at the outer and inner surface of each such hole, comprises two first opposing sides being parallel to each other and perpendicular to a centerline of the nozzle body, each such hole comprising two opposing planes extending from the outer to the inner surface of the nozzle body, each opposing plane of each such hole being limited by the first opposing sides at the outer and inner surface, and the two opposing planes of each such hole being inclined with respect to each other at an angle of 20° to 45°.

13. The nozzle for generating a water shield according to claim 12, wherein the cross-section of each of the multiple holes, at the outer and inner surface of each such hole, comprises two first opposing sides being parallel to each other and perpendicular to a centerline of the nozzle body, each such hole comprising two opposing planes extending from the outer to the inner surface of the nozzle body, each opposing plane of each such hole being limited by the first opposing sides at the outer and inner surface, and the two opposing planes of each such hole being inclined with respect to each other at an angle of 20° to 45°.

* * * * *